US008408838B2

(12) United States Patent
Willis et al.

(10) Patent No.: US 8,408,838 B2
(45) Date of Patent: Apr. 2, 2013

(54) MILLING MACHINE WITH CUTTER DRUM SPEED CONTROL

(75) Inventors: Paul E. Willis, Orrstown, PA (US); Justin Zupanc, Shippensburg, PA (US)

(73) Assignee: Volvo Construction Equipment AB, Eskilstuna (SE)

( * ) Notice: Subject to any disclaimer, the term of this patent is extended or adjusted under 35 U.S.C. 154(b) by 659 days.

(21) Appl. No.: 12/528,709

(22) PCT Filed: Mar. 20, 2008

(86) PCT No.: PCT/US2008/003702

§ 371 (c)(1), (2), (4) Date: Aug. 26, 2009

(87) PCT Pub. No.: WO2008/115560

PCT Pub. Date: Sep. 25, 2008

(65) Prior Publication Data

US 2010/0014917 A1 Jan. 21, 2010

Related U.S. Application Data

(60) Provisional application No. 60/919,016, filed on Mar. 20, 2007.

(51) Int. Cl.
*E01C 23/07* (2006.01)

(52) U.S. Cl. ..... 404/84.05; 404/94; 299/1.5

(58) Field of Classification Search ..... 404/84.05, 404/93, 94; 299/1.5, 1.8, 39.4
See application file for complete search history.

(56) References Cited

U.S. PATENT DOCUMENTS

| | | | | |
|---|---|---|---|---|
| 3,888,542 | A * | 6/1975 | Gowler | 299/1.5 |
| 4,929,121 | A * | 5/1990 | Lent et al. | 404/84.05 |
| 6,113,310 | A * | 9/2000 | Hesse, Jr. | 404/108 |
| 6,755,482 | B2 | 6/2004 | Johnson | |
| 6,921,230 | B2 | 7/2005 | Silay | |
| 2006/0129280 | A1 | 6/2006 | Thomas et al. | |
| 2009/0311045 | A1 * | 12/2009 | Jurasz et al. | 404/75 |

* cited by examiner

*Primary Examiner* — Matthew D Troutman
(74) *Attorney, Agent, or Firm* — Michael Best & Friedrich LLP

(57) ABSTRACT

A milling machine includes a main frame, a rotatable cutter drum coupled with the frame, and an engine mounted to the frame and operatively connected with the drum, and crawler assemblies connected with the frame and including a hydraulic motor. A pump is disposed on the frame for driving the crawler motor and is adjustable to vary a speed of the motor. A regulator adjusts cutter drum speed, a speed selector generates an input corresponding to a desired drum speed, and a sensor senses a drum speed. A control receives input from the selector and the sensor and operates the regulator such that drum speed corresponds to the desired speed. Further, the control also compares sensed drum speed with desired drum speed and adjusts the pump to reduce crawler motor speed when the sensed drum speed has a value lesser than a predetermined portion of the desired drum speed.

27 Claims, 7 Drawing Sheets

MILLING MACHINE WITH CUTTER DRUM SPEED CONTROL

CROSS-REFERENCE TO RELATED APPLICATIONS

This patent application is a national stage filing under 35 U.S.C. 371 of International Application No. PCT/US2008/003702, filed 20 Mar. 2008, which claims the benefit of priority to U.S. Application Ser. No. 60/919,016, filed 20 Mar. 2007, the disclosures of each of which are incorporated by reference herein in their entireties. Priority to each application is hereby claimed.

The present invention relates to road milling machines, and more particularly to systems for controlling milling machine operation.

Road milling machines typically include a main frame, a rotatable cutter drum mounted to the frame, and three or four crawler assemblies for mobilizing the machine. The cutter drum engages with a material surface, typically roadway pavement, such that the material is cut away from the roadway. Such milling machines generally further include a conveyor assembly for removing the material cuttings off of the roadway, often to a dump truck or similar transport vehicle.

SUMMARY OF THE INVENTION

In one aspect, the present invention is a milling machine comprising a main frame, a rotatable cutter drum coupled with the frame, and an engine mounted to the frame and operatively connected with the drum. A regulator is configured to adjust a speed of the cutter drum and a speed selector is configured to generate an input corresponding to a desired drum cutting speed. Further, a control is configured to receive the input from the selector and to operate the regulator such that the drum speed at least generally corresponds to the desired speed.

In another aspect, the present invention is a milling machine comprising a main frame, a rotatable cutter drum coupled with the frame, and at least one crawler assembly connected with the frame and including a hydraulic motor. A pump is disposed on the frame and is configured to drive the crawler motor, the pump being adjustable to vary a speed of the crawler motor. Further, a sensor is configured to sense a speed of the cutter drum and a control is configured to receive input from the sensor. The control is further configured to compare sensed drum speed with a desired drum speed and to adjust the pump to reduce the speed of the crawler motor when the sensed drum speed has a value lesser than a predetermined portion of the desired drum speed.

In a further aspect, the present invention is again a milling machine comprising a main frame, a rotatable cutter drum coupled with the frame, and an engine mounted to the frame. The engine is operatively connected with the cutter drum so as to directly drive the drum and includes a fuel line configured to provide fuel to the engine. A regulator is configured to adjust a flow rate of fuel through the fuel line so as to vary the engine speed and thereby adjust a speed of the cutter drum. A speed selector is configured to generate an input corresponding to a desired drum cutting speed. Further, a control is configured to receive the input from the selector and to operate the regulator such that the drum speed at least generally corresponds to the desired speed.

BRIEF DESCRIPTION OF THE SEVERAL VIEWS OF THE DRAWINGS

The foregoing summary, as well as the detailed description of the preferred embodiments of the present invention, will be better understood when read in conjunction with the appended drawings. For the purpose of illustrating the invention, there is shown in the drawings, which are diagrammatic, embodiments that are presently preferred. It should be understood, however, that the present invention is not limited to the precise arrangements and instrumentalities shown. In the drawings.

DETAILED DESCRIPTION OF THE INVENTION

Figure 1:
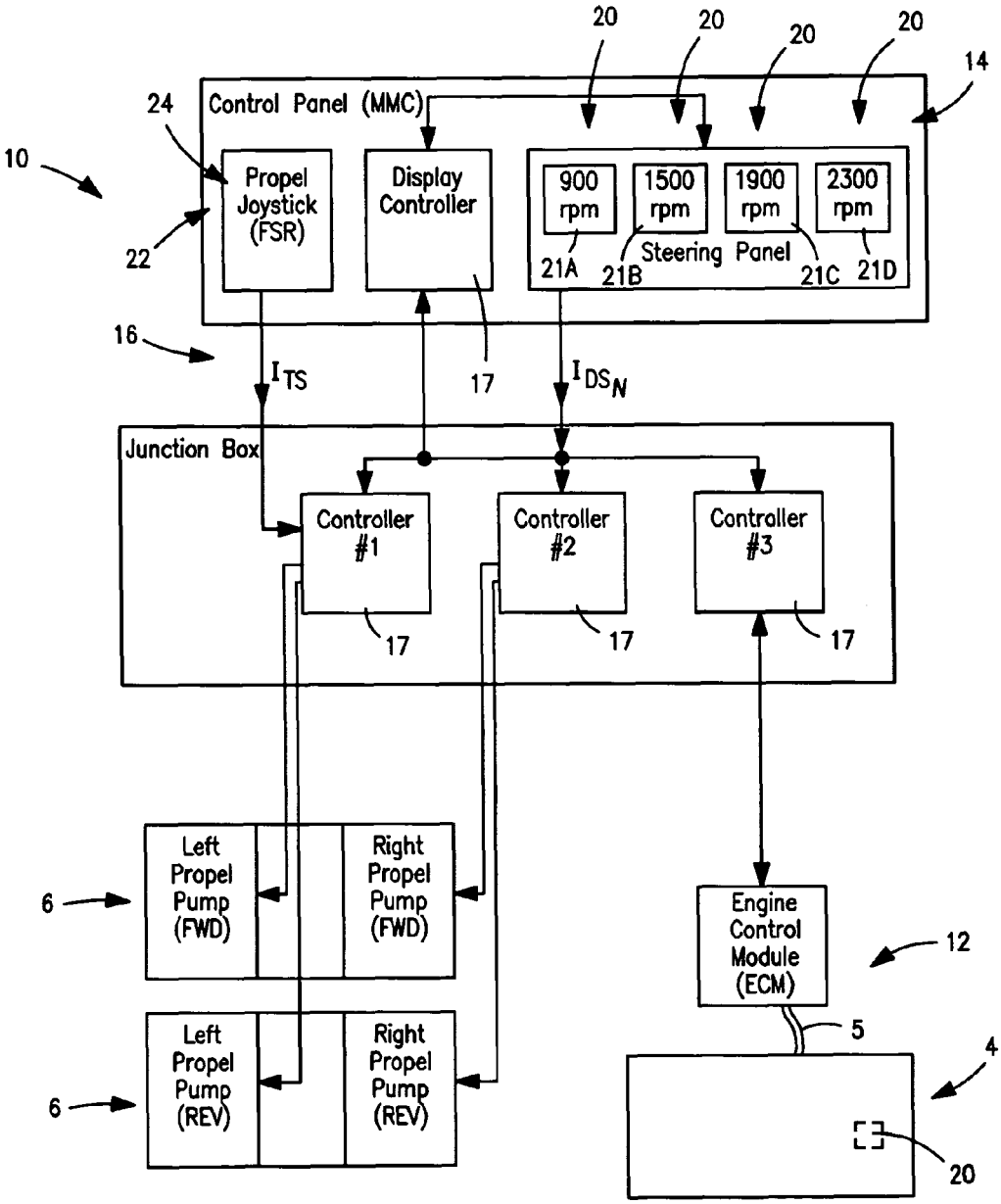
FIG. 1 is a schematic view of a control system for a milling machine, in accordance with the present invention.
Figure 2:
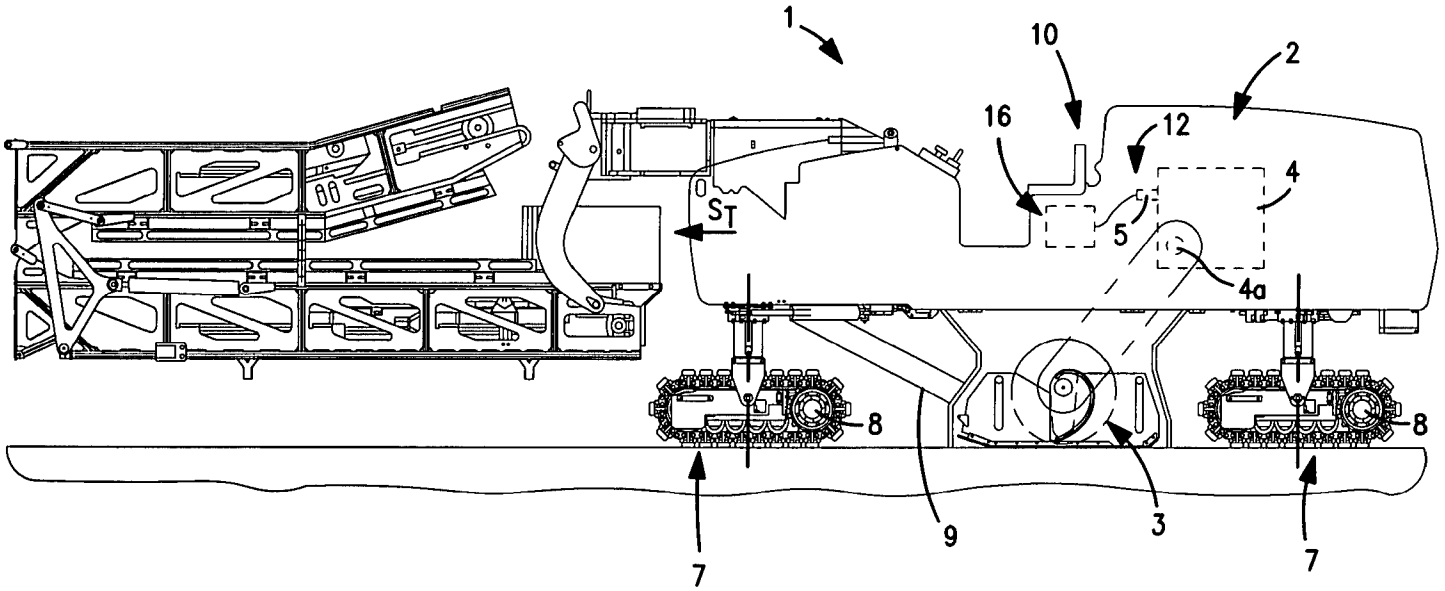
FIG. 2 is a side elevational view of a milling machine with a control system in accordance with the present invention.

Certain terminology is used in the following description for convenience only and is not limiting. The words "right", "left", "lower", "upper", "upward", "down" and "downward" designate directions in the drawings to which reference is made. The words "inner", "inwardly" and "outer", "outwardly" refer to directions toward and away from, respectively, a designated centerline or a geometric center of an element being described, the particular meaning being readily apparent from the context of the description. Further, as used herein, the word "connected" is intended to include direct connections between two members without any other members interposed therebetween and indirect connections between members in which one or more other members are interposed therebetween. The terminology includes the words specifically mentioned above, derivatives thereof, and words of similar import.

Referring now to the drawings in detail, wherein like numbers are used to indicate like elements throughout, there is shown in FIGS. 1-9 a control system 10 for a milling machine 1. The milling machine 1 includes a main frame 2, a rotatable cutter drum 3 coupled with the frame 2, and an engine 4 mounted to the frame 2 and operatively connected with the drum 3. The control system 10 basically comprises a regulator 12 configured to adjust a speed of the cutter drum 3, a drum speed selector 14 configured to generate an input $I_{DS}$ corresponding to a desired drum cutting speed $DS_D$, and a control 16. The control 16 is configured to receive the input $I_{DS}$ from the selector 14 and to operate the regulator 12 such that the actual drum speed DS at least generally corresponds to the desired speed $DS_D$. Preferably, the control 16 includes at least one microprocessor 17 electrically connected with the speed selector 14 and with the regulator 12, but may alternatively be constructed in any other appropriate manner, such as for example, fabricated of one or more analog circuits (none shown).

Preferably, the drum speed selector 14 includes a plurality of the input members 20, most preferably a plurality of buttons 21A, 21B, 21C, 21D, etc., each input member 20 being configured to generate a separate one of a plurality of inputs $I_{DS1}$, $I_{DS2}$, $I_{DS3}$, $I_{DS4}$, etc. Each one of the inputs $I_{DS1}$, $I_{DS2}$, $I_{DS3}$, $I_{DS4}$, etc., corresponds to a separate desired drum speed $DS_{D1}$, $DS_{D2}$, $DS_{D3}$, $DS_{D4}$, etc., and each desired speed $DS_{D1}$, $DS_{D2}$, $DS_{D3}$, $DS_{D4}$, etc., has a magnitude different than each other desired speed. In other words, each input member 21N is configured to provide a different input $ID_{SN}$ that corresponds to a different desired rotational speed $DS_{DN}$ of the cutter drum 3, for example, 900 rpm, 1500 rpm, 1900 rpm, and 2400 rpm. Alternatively, the drum speed selector 14 may include only a single input member (not shown), such as a rotatable knob, a shiftable lever, etc., configured to generate the plurality of different inputs $I_{DS1}$, $I_{DS2}$, $I_{DS3}$, $I_{DS4}$, etc., each corresponding to a separate, different desired drum speed $DS_{D1}$, $DS_{D2}$, $DS_{D3}$, $DS_{D4}$, etc.

Most preferably, the control 16 is configured to provide a first drum speed $DS_{D1}$, a second drum speed $DS_{D2}$, a third drum speed $DS_{D3}$, and a fourth drum speed $DS_{D4}$, each in response to inputs $I_{DS1}$, $I_{DS2}$, $I_{DS3}$, $I_{DS4}$, as follows. The first speed setting $DS_{D1}$ corresponds to an idle speed, for example of nine hundred rotations per minute (900 rpm), for use when the machine 1 is not working (i.e., drum 3 not cutting) and which minimizes noise and fuel consumption. The second speed setting $DS_{D2}$ corresponds to a high torque cutting speed, for example of fifteen hundred rotations per minute (1500 rpm), for cutting through harder material and at lower machine travel speed $S_T$. Further, the third speed setting $DS_{D3}$ corresponds to a standard cutting speed, for example of nineteen hundred rotations per minute (1900 rpm), for use of maximum horsepower in standard cutting operations. Finally, the fourth speed setting $DS_{D4}$ corresponds to a maximum or high cutting speed, for example of twenty-four hundred rotations per minute (2300 rpm), for use at higher vehicle travel speeds $S_T$ and preferably when cutting at shallower or lesser depths. Although the above four speed settings are preferred, the control 16 may be configured or constructed (e.g., programmed, wired, etc.) to provide any other appropriate speed settings $DS_{DN}$.

Further, the engine 4 is preferably configured to directly drive the cutter drum 3 and the regulator 12 is configured to adjust a speed of the engine 4 so as to thereby adjust the drum speed DS. Most preferably, the engine 4 includes a fuel line 5 configured to provide fuel to the engine 4 and the regulator 12 is configured to adjust a flow rate of fuel through the fuel line 5. As such, the regulator 12 varies the engine speed by adjusting the fuel flow rate, and thereby adjusts the cutter drum speed DS. However, the regular 12 may be alternatively configured to adjust a throttle or other component of the engine 4 so as to thereby adjust the speed DS of the drum 3. As a further alternative, the engine 4 may drive the drum 3 through a transmission, such as a belt-and-pulley system or a gear train (neither depicted), and the regulator 12 may be configured to adjust the transmission to controllably vary the drum speed DS. The scope of the present invention includes the above-described structures and any other appropriate construction of the regulator 12 that is capable of adjusting engine speed to correspondingly vary or adjust cutter drum speed DS.

Figure 3:
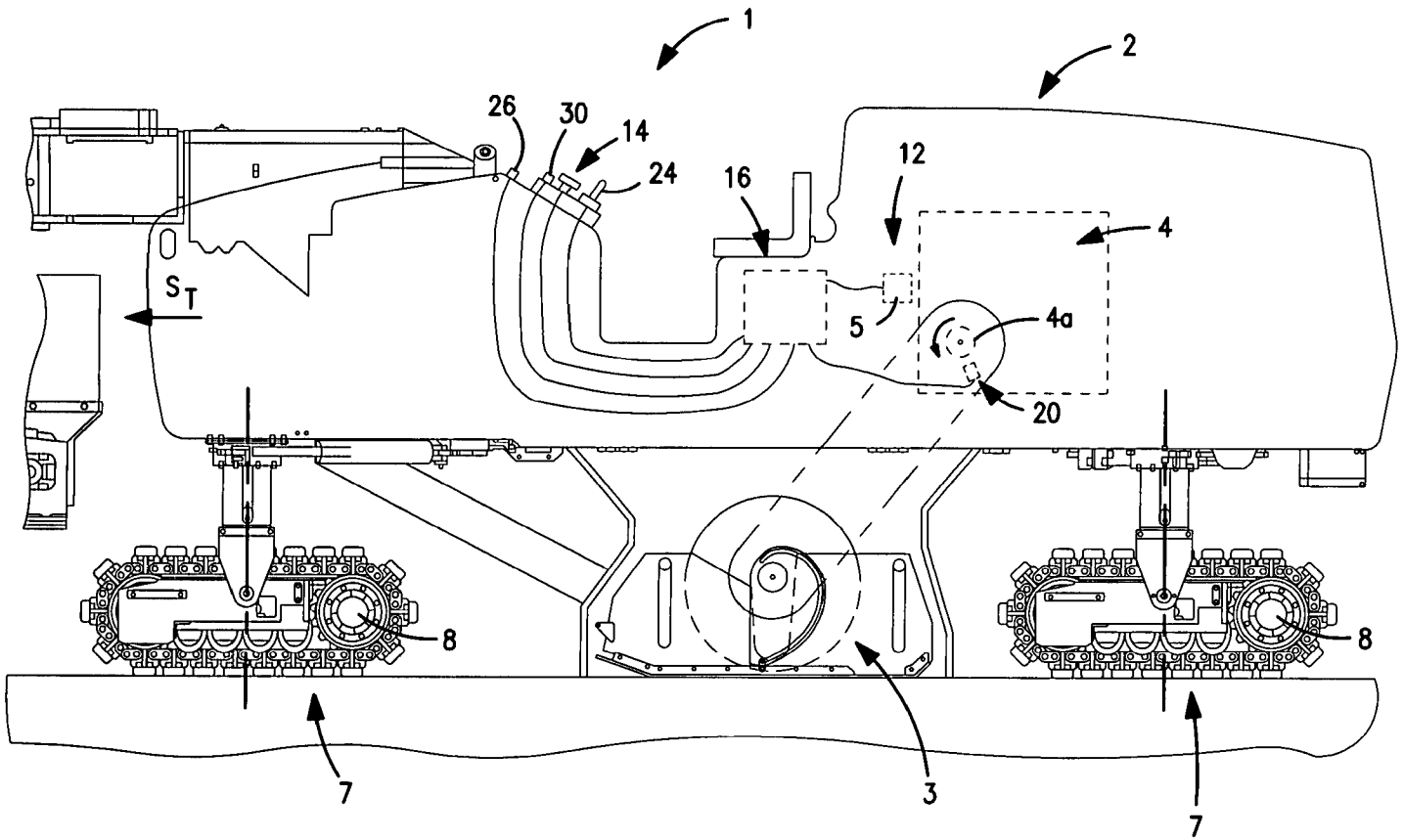
FIG. 3 is an enlarged, broken-away view of a portion of the milling machine of FIG. 2.
Figure 4:
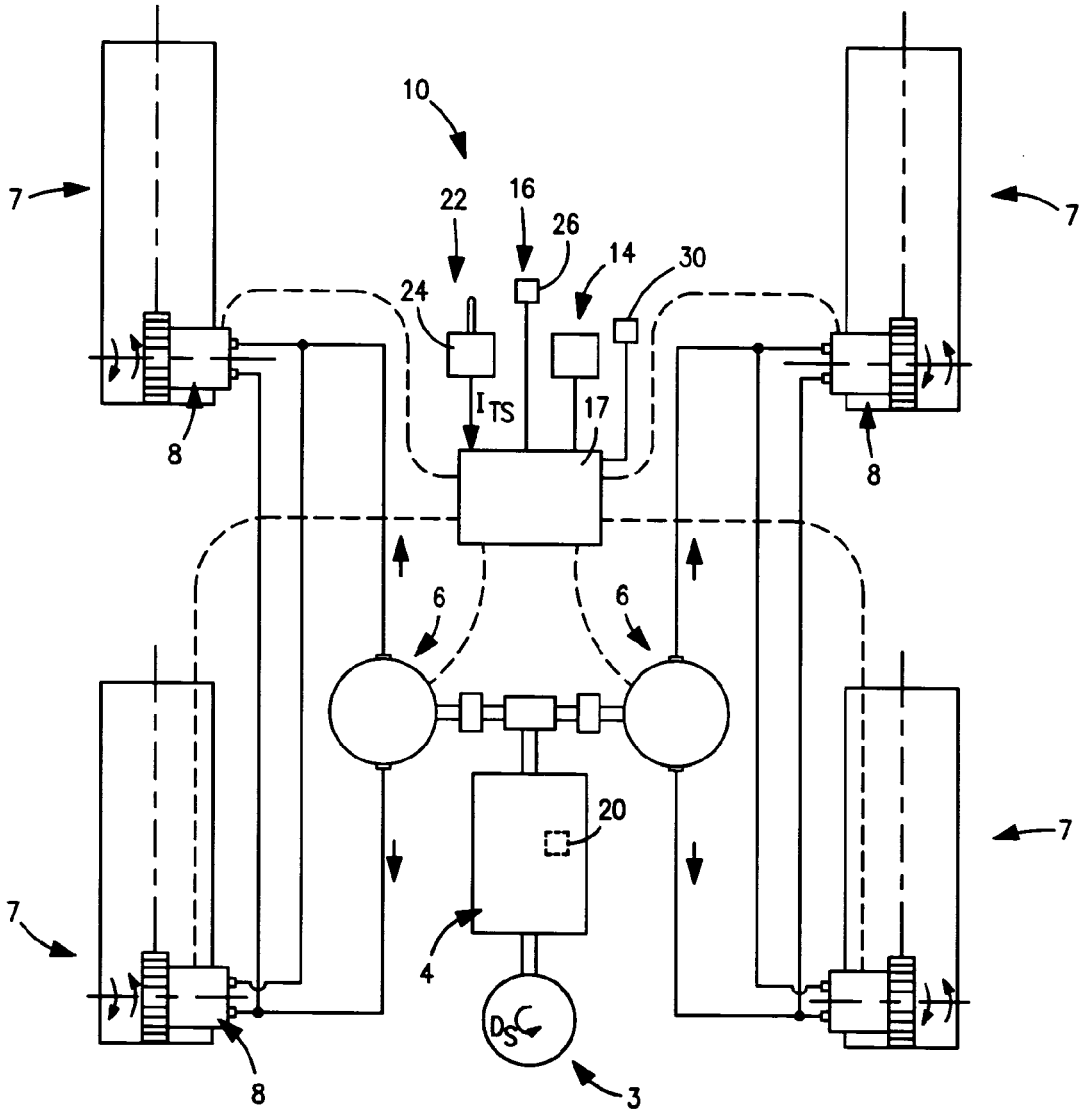
FIG. 4 is a more diagrammatic view of the milling machine and control system.

Referring to FIGS. 1, 3 and 4, the control system 10 preferably further comprises a sensor 20 configured to sense the actual drum speed DS and to communicate with the control 16, such as by transmitting a signal corresponding to drum speed DS. Preferably, the sensor 20 senses the rotational speed of the engine shaft 3*a*, most preferably by sensing an internal engine component such as the crank shaft, etc., so as to indirectly sense drum speed DS. However, the sensor 20 may alternatively directly sense or measure the drum speed DS, for example by directly measuring rotational speed of the drum shaft 3*a* or the drum 3 itself. In any case, the control 16 is further configured to compare sensed drum speed $DS_S$ with desired drum speed $DS_D$ and to operate the regulator 12 such that the sensed drum speed $DS_S$ is generally equal to the desired drum speed $DS_D$.

When the engine 4 is configured to directly drive the cutter drum 3 as preferred, the regulator 12 is configured to adjust a speed of the engine 4 so that the sensed drum speed $DS_S$ is generally equal to the desired drum speed $DS_D$. Specifically, the control 16 preferably operates the regulator 12 so as to increase the fuel flow rate to the engine 4 when the sensed drum speed $DS_S$ is less than the desired drum speed $DS_D$. Alternatively, the control 16 operates the regulator 12 so as to decrease the fuel flow rate to the engine 4 when the sensed drum speed $DS_S$ is greater than the desired drum speed $DS_D$.

Referring to FIGS. 5-8, the milling machine 1 preferably further includes at least one and preferably two pumps 6 and at least one and preferably four crawler assemblies 7, each crawler assembly 7 including at least one drive motor 8 connected with a drive wheel 7*a*. Each of the two preferred pumps 6 is preferably configured to operatively drive two of the crawler motors 8, and thereby the associated crawler assemblies 7 through the crawler drive wheel 7*a*. However, each pump 6 may be configured to drive only a single crawler motor 8 or/and the milling machine 1 may only include a single pump 6 operating one or more motors 8. In any case, each pump 6 is preferably adjustable to vary a speed of the crawler motor 8. Preferably, the pumps 6 each have a variable fluid displacement and the control 16 is configured to adjust the pump displacement so as to adjust the crawler motor speed. Most preferably, each pump 6 is an axial piston pump with an actuator 6*a* for adjusting an angle $A_P$ of a swash plate 6*b*, thereby adjusting the pump displacement, but may alternatively be constructed in any other appropriate manner.

Figure 9:
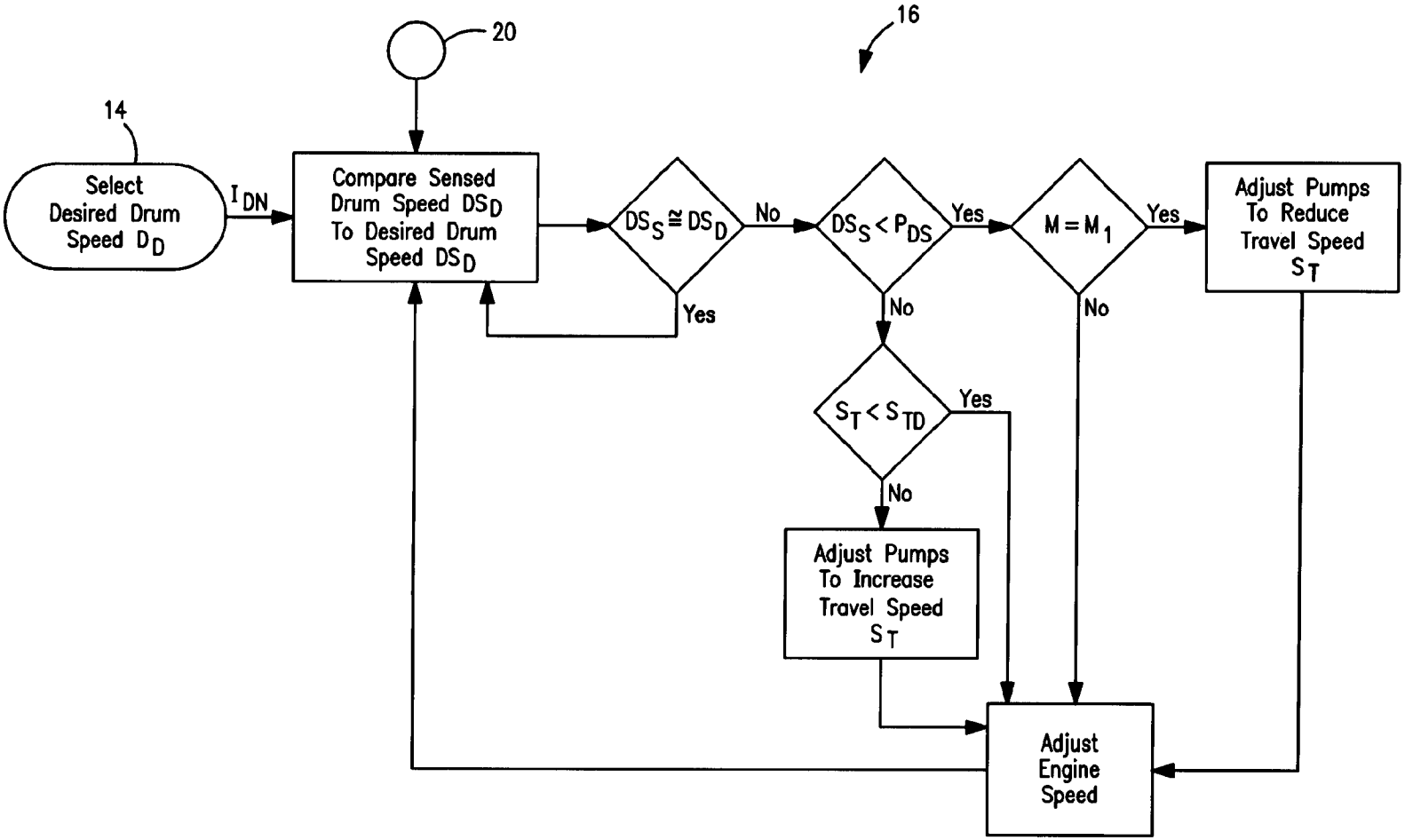
FIG. 9 is a logic flow chart depicting preferred operating features of a control.

Referring to FIG. 9, with the preferred pumps 6 and crawler assemblies 7 as described above, the control 16 is preferably further configured to compare the sensed drum speed $DS_S$ with the desired speed $DS_D$ and to adjust the pumps 6 to reduce the speed of the crawler motors 8 when the sensed drum speed $DS_S$ has a value lesser than a predetermined portion $P_{DS}$ of the desired speed $DS_D$. In other words, when the control 16 determines that the cutter drum 3 is rotating at a speed $DS_S$ that is less than a certain portion of percentage (e.g., ⅔, 80%, etc.) of the desired speed $DS_D$, the control 16 will adjust the pumps 6 in order to reduce crawler motor speed, and thereby reduce the milling machine travel speed. As such, the control 16 causes the milling machine travel speed $S_T$ to be reduced whenever the cutting drum 3 is rotating at less than a desired speed $DS_D$, which generally indicates that the load on the drum 3 is greater than desired (e.g., drum 3 begins cutting relatively harder material). More specifically, when the drum 3 is cutting a relatively harder material or at relatively greater depth, the torque required to cut the material increases, which causes the rotational speed DS of the drum 3 to decrease. By correspondingly reducing the machine travel speed $S_T$, the quality or smoothness of a cut material surface is improved by prevention of "skipping" of drum cutting teeth (not depicted), which can occur when the drum speed DS is lower than preferred for a given machine travel speed $S_T$.

Further, the control 16 is also configured to adjust the pumps 6 so as to increase the speed of the crawler motors 8 when the value of the sensed drum speed $DS_S$ increases from lesser than or about the predetermined portion $P_{DS}$ of the desired speed to either greater than the desired speed predetermined portion $P_{DS}$ or to about the desired speed $DS_D$. In other words, the control 16 will adjust the pumps 6 to increase the machine travel speed $S_T$ back to a desired speed when the rotational speed DS of the cutting drum 3 increases to, or at least sufficiently toward (i.e., above specified portion), the desired drum speed $DS_D$, indicating that the load on the drum 3 has been reduced (e.g., moving from harder to softer material, cutting depth reduced, etc.). Thus, the control 16 preferably provides a "load control" feature that decreases the machine travel speed $S_T$ whenever the load on the drum 3 is sufficiently increased so as to lower the drum speed DS substantially below a desired speed, and returns the travel speed $S_T$ to a desired value when the drum load is reduced.

Figure 5:
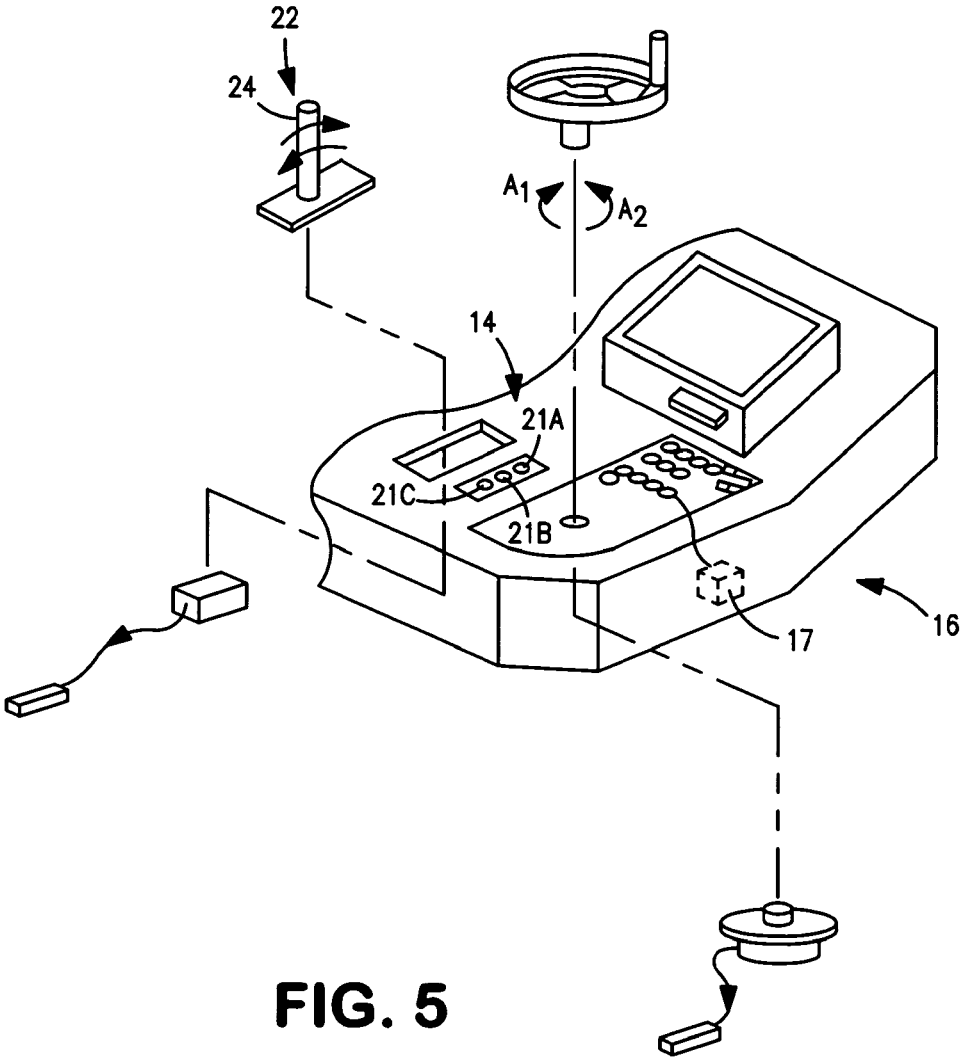
FIG. 5 is a broken-away, enlarged perspective view of a portion of an operator control panel for the milling machine control system.
Figure 6:
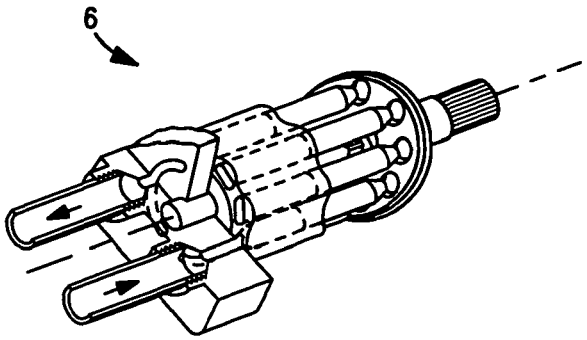
FIG. 6 is a perspective view of a preferred pump.
Figure 7:
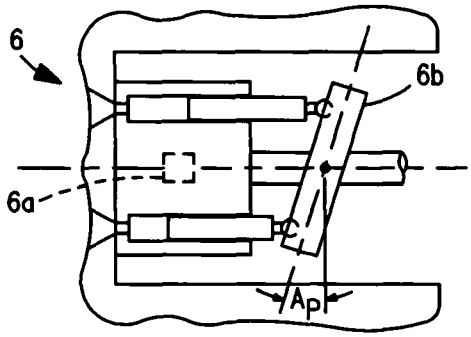
FIG. 7 is a more diagrammatic view of the pump of FIG. 6.
Figure 8:
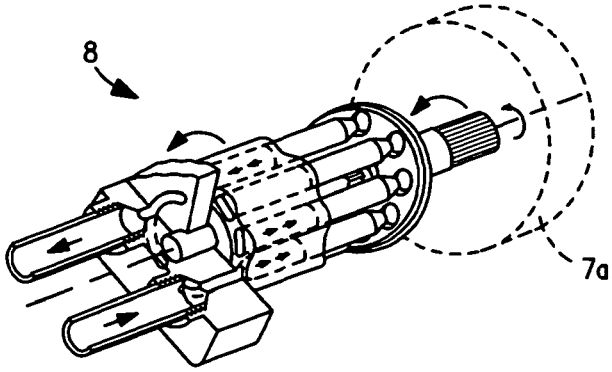
FIG. 8 is a perspective view of a preferred crawler motor, shown with a drive wheel in phantom.

Referring to FIGS. 1, 3 and 5, the control system 16 preferably further comprises a travel speed input device 22 configured to generate a travel speed input $I_{TS}$ corresponding to a desired travel speed of the milling machine 1 and to communicate the input to the control 16. The travel speed input device 22 preferably includes a shiftable lever or joystick 24 configured to provide a desired speed input from zero to a maximum value, but may be constructed in any appropriate manner. Further, the control 16 is configured to receive the travel speed input $I_{TS}$ and to adjust the pumps 6 such that the crawler motor speed generally corresponds to the desired travel speed $S_T$, preferably subject to the "load control" feature described above. That is, the control 16 is configured to adjust the pumps 6 such that the crawler motor speed generally corresponds to the desired travel speed $S_T$ when the sensed drum speed $S_{DS}$ is above the predetermined portion of the desired drum speed $DS_D$. However, the control 16 alternatively adjusts the pumps 6 to reduce the speed of the crawler motors 8, and/or disregards a travel speed $I_{TS}$ that would increase travel speed $S_T$ when the sensed drum speed $DS_S$ has a value lesser than the predetermined drum speed portion.

In other words, the control 16 preferably permits a machine operator to vary the vehicle travel speed as desired, through the travel speed input device 22, only when the sensed drum speed $DS_S$ is within a certain portion or percentage of the desired drum speed $DS_D$. When the sensed drum speed $DS_S$ is below the predetermined portion/percentage of the desired drum speed $DS_D$, the control 16 will "scale" the travel speed input $I_{TS}$ from the travel speed input device 22 such that the control 16 only provides a portion of the input to the pumps 6, thereby reducing crawler motor speed, until the sensed drum speed $DS_S$ again increases above the predetermined portion/percentage or is at or about the desired drum speed $DS_D$.

Most preferably, the control 16 is configured to selectively operate in at least first and second control modes $M_1$, $M_2$. In the first or "load control" mode $M_1$, the control 16 adjusts the pumps 6 to reduce the speed of the crawler motors 8 whenever the sensed drum speed $DS_S$ has a value lesser than the predetermined portion of the desired speed $DS_D$, as described above. In the second control mode $M_2$, the control 16 permits the sensed drum speed $DS_S$ to be lesser than the predetermined portion of the desired drum speed $DS_D$ without adjustment of the pumps 6. That is, when operating in the second mode $M_2$, the control 16 permits a machine operator to drive the milling machine 1 at any desired travel speed $S_T$ regardless of the drum speed DS, and will not automatically reduce the machine travel speed $S_T$ (i.e., by adjusting pump displacement) when the sensed drum speed $DS_S$ falls below a predetermined portion/percentage of the desired speed $DS_D$. Further, the control system 10 preferably further comprises a mode selector 26, such as a pushbutton, knob, etc., configured to adjust the control 16 between the first and second control modes $M_1$, $M_2$ as desired by the machine operator.

Furthermore, the control system 10 preferably further comprises a "pause" input device 30 configured to provide or communicate a pause input $I_P$ to the control 16 and the control 16 is further configured to take one or more, and preferably all, of the following actions: to reduce engine speed $E_S$, to activate one or more brake mechanism (none shown), to adjust the crawler motors 8 so as to stop crawler rotation (and thus machine propulsion/displacement), to turn off one or more wetting devices or water sprayers (none shown), and to turn off a conveyor 9 when the control 16 receives the pause device input $I_P$. Most preferably, the control 16 is configured to take one of the above "pause" actions when the control 16 receives a first or "pause" input $I_{P1}$ from the pause input device 16 and is configured to take at least one of the following actions when the control 16 receives a second or "resume" input $I_{P2}$ from the pause input device 30: increase engine speed, deactivate the brake mechanism, adjust the crawler motors 8 to start crawler rotation, turn on wetting devices or sprayers, and/or to turn on the conveyor 9.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A milling machine comprising:

a main frame;

a rotatable cutter drum coupled with the frame;

an engine mounted to the frame and operatively connected with the drum;

a regulator configured to adjust a speed of the cutter drum;

a speed selector configured to generate an input corresponding to a desired drum cutting speed; and a control configured to receive the input from the selector and to operate the regulator such that the drum speed at least generally corresponds to the desired speed;

further comprising:

at least one crawler assembly including a hydraulic motor;

a pump configured to drive the crawler motor and being adjustable to vary a speed of the crawler motor; and a sensor configured to sense a speed of the drum and to communicate with the control;

wherein the control is configured to compare sensed drum speed with the desired drum speed and to adjust the pump to reduce the speed of the crawler motor when the sensed drum speed has a value less than a predetermined portion of the desired drum speed, the predetermined portion of the desired drum speed being less than the desired drum speed;

further comprising a travel speed input device configured to generate a travel speed input corresponding to a desired travel speed of the vehicle, the control being configured to receive the travel speed input, to adjust the pump such that the speed of the crawler motor generally corresponds to the desired travel speed when the drum speed is greater than the predetermined drum speed portion, and to alternatively adjust the pump to reduce the speed of the crawler motor when the sensed drum speed has a value less than the predetermined speed portion.

2. The milling machine as recited in claim 1 wherein the speed selector includes one of:

a plurality of the input members, each input member being configured to generate a separate one of a plurality of inputs, each one of the inputs corresponding to a separate desired speed, each desired speed having a magnitude different than each other desired speed; and an input member configured to generate a plurality of inputs, each one of the inputs corresponding to a separate desired speed, each desired speed having a magnitude different than each other desired speed.

3. The milling machine as recited in claim 1 wherein the engine is configured to directly drive the cutter drum and the regulator is configured to adjust a speed of the engine so as to adjust the drum speed.

4. The milling machine as recited in claim 3 wherein the engine includes a fuel line configured to provide fuel to the engine and the regulator is configured to adjust a flow rate of fuel through the fuel line so as to vary the engine speed.

5. The milling machine as recited in claim 1 wherein the control is further configured to compare sensed drum speed with desired drum speed and to operate the regulator such that the sensed drum speed is generally equal to the desired drum speed.

6. The milling machine as recited in claim 5 wherein the engine is configured to directly drive the cutter drum and the regulator is configured to adjust a speed of the engine so that the sensed drum speed is generally equal to the desired drum speed.

7. The milling machine as recited in claim 6 wherein the sensor is configured to measure one of drum speed and engine speed.

8. The milling machine as recited in claim 1 wherein the control includes a microprocessor electrically connected with the speed selector and with the regulator.

9. The milling machine as recited in claim 1 wherein the control is further configured to adjust the pump so as to increase the speed of the crawler motor when the sensed drum speed increases from a value of less than the predetermined speed portion to a value of one of greater than the predetermined speed portion and about the desired drum speed.

10. The milling machine as recited in claim 1 wherein the sensor is configured to directly sense a speed of the engine so as to sense drum speed.

11. The milling machine as recited in claim 1 wherein the pump has a variable fluid displacement and the control is configured to adjust the pump displacement so as to adjust the crawler motor speed.

12. The milling machine as recited in claim 1 wherein the control is configured to selectively operate in a first control mode in which the control adjusts the pump to reduce the speed of the crawler motor whenever the sensed drum speed has a value less than the predetermined drum speed portion and to alternatively operate in a second mode in which the control permits the drum speed to be less than the predetermined speed portion without adjustment of the pump.

13. The milling machine as recited in claim 12 further comprising a mode selector configured to adjust the control between the first and second control modes.

14. The milling machine as recited in claim 1 further comprising a pause input device configured to provide an input to the control and the control is configured to at least one of reduce engine speed, activate a brake mechanism, adjust a crawler motor so as to stop crawler rotation, turn off a watering system, and to turn off a conveyor when the control receives the pause device input.

15. The milling machine as recited in claim 14 wherein:

the control is configured to at least one of reduce engine speed, activate a brake mechanism, adjust a crawler motor so as to stop crawler rotation, turn off a watering system, and to turn off a conveyor when the control receives a first input from the pause input device; and the control is configured to at least one of increase engine speed, deactivate a brake mechanism, adjust a crawler motor so as to start crawler rotation, turn on a watering system, and to turn on a conveyor when the control receives a second input from the pause input device.

16. The milling machine as recited in claim 1 wherein the predetermined portion is less than about 80% of the desired drum speed.

17. The milling machine as recited in claim 16 wherein the predetermined portion is about two-thirds of the desired drum speed.

18. A milling machine comprising:

a main frame;

a rotatable cutter drum coupled with the frame;

at least one crawler assembly connected with the frame and including a hydraulic motor;

a pump disposed on the frame and configured to drive the crawler motor, the pump being adjustable to vary a speed of the crawler motor;

a sensor configured to sense a speed of the cutter drum; and a control configured to receive input from the sensor, to compare sensed drum speed with a desired drum speed, and to adjust the pump to reduce the speed of the crawler motor when the sensed drum speed has a value less than a predetermined portion of a desired drum speed, the predetermined portion of the desired drum speed being less than the desired drum speed.

19. The milling machine as recited in claim 18 wherein the control is further configured to adjust the pump so as to increase the speed of the crawler motor to a desired travel speed when the sensed drum speed increases from a value less than the predetermined speed portion to a value one of greater than the predetermined speed portion and about the desired drum speed.

20. The milling machine as recited in claim 18 wherein the pump has a variable fluid displacement and the control is configured to adjust the pump displacement so as to adjust the crawler motor speed.

21. The milling machine as recited in claim 18 wherein the control is configured to selectively operate in a first control mode in which the control adjusts the pump to reduce the speed of the crawler motor whenever the sensed drum speed has a value less than the predetermined portion of the desired speed and to alternatively operate in a second mode in which the control permits the sensed drum speed to have a value less than the predetermined portion of the desired drum speed without adjustment of the pump.

22. The milling machine as recited in claim 18 further comprising:

a regulator configured to adjust a speed of the cutter drum; and a speed selector configured to generate an input corresponding to a desired drum speed; and wherein the control is further configured to receive the input from the selector and to operate the regulator such that the drum speed at least generally corresponds to the desired speed.

23. The milling machine as recited in claim 18 wherein the predetermined portion is less than about 80% of the desired drum speed.

24. The milling machine as recited in claim 23 wherein the predetermined portion is about two-thirds of the desired drum speed.

25. A milling machine comprising:

a main frame;

at least one crawler assembly including a hydraulic motor;

a pump configured to drive the crawler motor and being adjustable to vary a speed of the crawler motor;

a travel speed input device configured to generate a travel speed input corresponding to a desired travel speed of the vehicle;

a rotatable cutter drum coupled with the frame;

an engine mounted to the frame, operatively connected with the cutter drum so as to directly drive the drum, and including a fuel line configured to provide fuel to the engine;

a regulator configured to adjust a flow rate of fuel through the fuel line so as to vary the engine speed and adjust a speed of the cutter drum;

a speed selector configured to generate an input corresponding to a desired drum speed;

a sensor configured to sense a speed of the drum; and a control configured to receive the input from the selector and to operate the regulator such that the drum speed at least generally corresponds to the desired drum speed, the control being configured to receive the travel speed input;

wherein the control is configured to compare a sensed drum speed with the desired drum speed, the control being configured to adjust the pump such that the speed of the crawler motor generally corresponds to the desired travel speed when the sensed drum speed is greater than a predetermined drum speed portion of the desired drum speed, the predetermined portion of the desired drum speed being less than the desired drum speed, the control being configured to adjust the pump to reduce the speed of the crawler motor when the sensed drum speed has a value less than the predetermined portion of the desired drum speed.

26. The milling machine as recited in claim 25 wherein the predetermined portion is less than about 80% of the desired drum speed.

27. The milling machine as recited in claim 26 wherein the predetermined portion is about two-thirds of the desired drum speed.

* * * * *

UNITED STATES PATENT AND TRADEMARK OFFICE

CERTIFICATE OF CORRECTION

PATENT NO. : 8,408,838 B2
APPLICATION NO. : 12/528709
DATED : April 2, 2013
INVENTOR(S) : Willis et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 660 days.

Signed and Sealed this
First Day of September, 2015

Michelle K. Lee

Michelle K. Lee
*Director of the United States Patent and Trademark Office*